US005974994A

United States Patent [19]

Stutznäcker et al.

[11] Patent Number: 5,974,994

[45] Date of Patent: Nov. 2, 1999

[54] METHOD AND A MULTIPLE-NEEDLE SEWING MACHINE FOR SEWING LARGE AREA SEWING MATERIAL

[75] Inventors: Klaus Stutznäcker, Frechen; Hartmut Klapp, Kaarst, both of Germany

[73] Assignee: Nähmaschinenfabrik Emil Stutznäcker GmbH & Co. KG, Germany

[21] Appl. No.: 08/826,085

[22] Filed: Mar. 20, 1997

[30] Foreign Application Priority Data

Mar. 20, 1996 [DE] Germany ..... 196 10 979

[51] Int. Cl.[6] ..... D05B 11/00

[52] U.S. Cl. ..... 112/118; 112/303

[58] Field of Search ..... 112/118, 163, 112/420.31, 420.32, 475.01, 475.04, 305, 312, 319, 132, 135, 144, 145, 303, 304

[56] References Cited

U.S. PATENT DOCUMENTS

| | | | |
|---|---|---|---|
| 3,198,149 | 8/1965 | Schlegel | 112/118 |
| 3,348,507 | 10/1967 | Kuhn | 112/118 |
| 3,960,095 | 6/1976 | Story | 112/118 |
| 5,544,599 | 8/1996 | Frazer et al. | 112/118 |

*Primary Examiner*—Ismael Izaguirre
*Attorney, Agent, or Firm*—Locke Liddell & Sapp LLP

[57] ABSTRACT

This invention relates to a method of sewing large area sewing material consisting of plural and at least two layers, of which at least one layer is formed of an elastical material, for instance foamed material, wherein said layers are fed to the sewing unit in a superposed relationship and wherein the layer of elastical material is fed to the sewing unit in an unexpanded and preferably bulged condition and is stitched together with the layer formed of non-elastical material. Such a method offers the advantage that the formation of folds in the stitched product is prevented in a simple and inexpensive manner.

26 Claims, 3 Drawing Sheets

METHOD AND A MULTIPLE-NEEDLE SEWING MACHINE FOR SEWING LARGE AREA SEWING MATERIAL

FIELD OF THE INVENTION

This invention relates to a method of sewing large area sewing material which consists of plural layers and of two layers at least, of which at least one layer is formed of an elastical material, for instance foamed material. A further subject of the invention is a multiple-needle sewing machine for sewing large area sewing material which consists of plural layers and of two layers at least, wherein at least one layer is formed of an elastical material, said sewing machine comprising a sewing unit, storage mechanism for the layers to be stitched, and storage means for withdrawing and receiving stitched layers from the sewing unit.

BACKGROUND OF THE INVENTION

Large area material is understood to be for instance mattress fabric that is to be stretched around mattress cores. The sewing material concerned is of the type including at least one layer of a non-elastical material and one layer of an elastical material, for example foamed material, to be stitched together, wherein the stitched seams are arranged according to a predetermined pattern and particularly do not run exclusively in one direction which means that arbitrary sewing patterns are produced such as bias check or check patterns, circular saw or circular patterns and quite arbitrary contours. With sewing material of that kind the problem arises that due to the common drive for all the layers up to the sewing unit the elastical layer is subject to an expansion in the longitudinal or feeding direction. This elastical expansion is caused particularly by the fact that the sewing material, i.e. at least the two layers mentioned above, is drawn towards the pressure foot and into the sewing unit via a support. On this occasion, the tractive forces are transmitted to the sewing material which is stitched after it has passed through the sewing unit and is rolled onto a storage means. Doing this, the layer of elastical material rests either directly or indirectly on the support in front of the pressure foot and needle plate. Due to the friction existing in this area between said support and said layer of elastical material the latter is expanded and is stitched together with the layer of non-elastical material in this expanded condition. When the now stitched material leaves the multiple-needle sewing machine and is either rolled onto the storage means or cut to individual segments, the elastical material will tend to assume its original expansion, i.e. it will shrink again. Due to the shrinking of the elastical material said non-elastical material will form folds that disturb particularly the aesthetic appearance of the article produced from that material, for example a mattress.

Basing on this prior art, it is a problem of the present invention to provide a method and a multiple-needle sewing machine of the type concerned, wherein the formation of folds in the stitched product is prevented in a simple and inexpensive way.

SUMMARY OF THE INVENTION

The solution of this problem provides for a method comprising the features of claim 1. Furthermore, the problem of the invention is solved by a multiple-needle sewing machine of the type concerned, wherein the sewing unit is topped with a device by means of which the layer of elastical material is, in an unexpanded and within the area of the device preferably bulged condition, fed to the sewing unit under maintaining said bulging, together with said at least one additional layer or additional layers.

Accordingly, an advantage of the method according to the invention resides in that the property of the layer of elastical material to expand due to friction is compensated by the fact that the elastical material is fed to the sewing unit in the unexpanded and preferably bulged condition. To this end, the layer of elastical material may be fed at a higher speed than the layer of non-elastical material so that for the sewing process a volume of elastical material which is higher than in prior art is stitched together with said layer of non-elastical material so that the formation of folds in the finished material is avoided by the fact that the elastical material cannot shrink at all or only to a small extent after the sewing process.

A further development of the method according to the invention provides for the layers to be conveyed through the sewing unit by means of a tractive force transmitted to the stitched material, particularly to the layer of non-elastical material. Accordingly, two forces are transmitted to the layer of elastical material, namely the tractive force by which the stitched material is withdrawn from the sewing unit, on one hand, and the force which is applied to the layer of elastical material due to the increased speed and by which said layer of elastical material is pushed towards said sewing unit, on the other hand.

A further feature of the invention provides for the unstitched layers to be guided under different angles via a deflection device before the layers enter said sewing unit between a pressure foot and a needle plate corresponding to a needle row or shuttle row. In this respect is has to be pointed out to the fact that the layer of elastical material, for example foamed material, has a greater material thickness than said layer of non-elastical material, for example mattress drill, and that guiding these two superposed layers over a deflection device leads to that the layer formed of elastical material is guided past said deflection device at a higher speed than the layer of non-elastical material, e.g. mattress drill, guided directly over said deflection device.

According to another feature of the invention it is provided that the layer formed of non-elastical material is fed to said deflection device under a larger angle relative to a plane of the deflection device preferably defined by the needle plate than said layer formed of elastical material. Here it is important that both layers are fed under an angle relative to the plane of the deflection device, wherein said layer of elastical material is fed preferably under an angle of at least 5 ° relative to said plane.

Alternatively it may be provided that the layer formed of elastical material is conveyed over a predetermined distance directly into the zone of the sewing unit by means of a driven conveying device, whereby the speed of the layer of elastical material is increased as compared to the speed of the layer of non-elastical material.

A particular advantage is that the layer formed of elastical material is bulged in the conveying direction at least in the zone in front of the sewing unit and that the layer formed of elastical material is fed to the sewing unit in said bulged condition and is stitched together with said layer of non-elastical material. Here it has shown to be an advantage that by the bulging of the elastical material and by the stitching of the bulged elastical material together with the non-elastical material the tendency of the elastical material to shrink after stitching does not exist, so that the formation of folds in the stitched non-elastical material is prevented. According to another feature of the invention it may be provided that the layer formed of elastical material is bulged corresponding to its possible expansion, so that the layer formed of elastical material expands to its original dimension after the stitching process. Accordingly, a compensation takes place of the tendency of the elastical material to expand due to the friction between said elastical material and the supporting surface over which the elastical material is drawn.

However, it is also conceivable that the layer formed of elastical material is bulged in front of the sewing unit to an extent which is greater than that of the possible and/or average expansion of the layer of elastical material along the conveying distance. In this way, the tendency of the elastical material to expand is overcompensated, so that the elastical material does not expand prior to its entry into the sewing unit but only after withdrawal of the stitched material and thus causes biasing of the layer of non-elastical material to a certain extent, by which biasing the formation of folds is prevented.

Finally, according to another feature of the invention it is provided that a further layer, preferably a fleece of chemical pulp and/or synthetic fibers, is additionally simultaneously fed with said layer of elastical material, wherein said layer of elastical material is arranged between said two layers.

Concerning the multiple-needle sewing machine according to the invention another feature provides that the device is configured as an at least circular arc segment-shaped deflection member that is arranged substantially directly in front of the pressure foot of the sewing unit. Said circular arc segment-shaped configuration has to extend over at least the portion which is necessary in order to guide said at least two layers over said circular arc segment corresponding to the predetermined angles, so that different relative speeds of said two layers will be produced. Preferably, said deflection member is in the form of a roller having a circular cross-section, onto which roller said layers ascend under different angles relative to the plane of the needle plate. It is further provided that the deflection member is arranged vis a vis a support, with a gap being maintained therebetween. Here it is an advantage that the layer of elastical material meets the layer of non-elastical material only shortly before the deflection point or at the deflection point of said circular arc segment-shaped device.

Preferably, the gap formed between the deflection member and the support is adjustable, so that material layers of different thickness may be processed, without adversely affecting the advantageous effect of the method or the multiple-needle sewing machine according to the invention. In this case, either the deflection member may be adjustable relative to said support or said support relative to said deflection member.

A further improvement of the multiple-needle sewing machine according the invention provides for the roller to be driven, so that through the drive of said roller an additional component force is transmitted to the layer of non-elastical material.

According to another feature of the invention it is provided that the deflection member is topped with a roller for guiding said layer of elastical material in such a fashion that this layer ascends the deflection member under an angle of at least 5 ° relative to the plane and that the layer of non-elastical material ascending between the layer of elastical material and the deflection member ascends said deflection member under an angle which is larger than the angle under which the layer of elastical material ascends. Preferably, said two layers to be superposed pass over two rollers which are arranged substantially horizontally one above the other, so that different ascending angles are produced in the zone of the deflection member.

An alternative form of construction of the multiple-needle sewing machine provides for the device to be formed as an endless conveyor including at least one conveyor belt onto which the layer of elastical material ascends. By means of this endless conveyor said layer of elastical material is moved at a higher speed than the layer of non-elastical material, so that bulging of this material takes place in front of the sewing unit. Particularly, it is provided that plural synchronized conveyor belts are arranged one beside the other, so that uniform movement of the layer consisting of elastical material is obtained throughout its width.

In order to maintain the bulging of the elastical material until a point immediately in front of the sewing unit, i.e. to avoid relaxing of the bulged material, another feature of this form of construction provides for the conveyor belt or belts to reach as far as up and into a zone directly in front of the pressure foot, so that the pressure foot clamps the layer of non-elastical material together with the layer of elastical material during the sewing operation.

In this respect it has shown to be an advantage that the conveyor belt or belts are surrounded by supporting surfaces at least in part-portions thereof, so that the layer of elastical material rests on said support or conveyor over its entire surface. Preferably, said supporting surface and the surface of said conveyor belts form an approximately flush surface. In this respect it is merely important that the conveyor belt or the conveyor belts protrude beyond said supporting surface to an extent which guarantees safe conveying of said layer of elastical material. Preferably, said supporting surfaces are arranged in the zone directly in front of the pressure foot and extend in the conveying direction of the sewing material.

Finally, another feature of the invention provides for the supporting surface to be formed as a dovetail sheet metal plate, of which the dovetails extend in the conveying direction and have arranged therebetween said conveyor belts.

Further features and advantages of the method according to the present invention and of the multiple-needle sewing machine according to the present invention will become apparent from the following description and the attached drawings representing a preferred embodiment of a multiple-needle sewing machine. In the drawings it is shown by:

DETAILED DESCRIPTION

Figure 1:
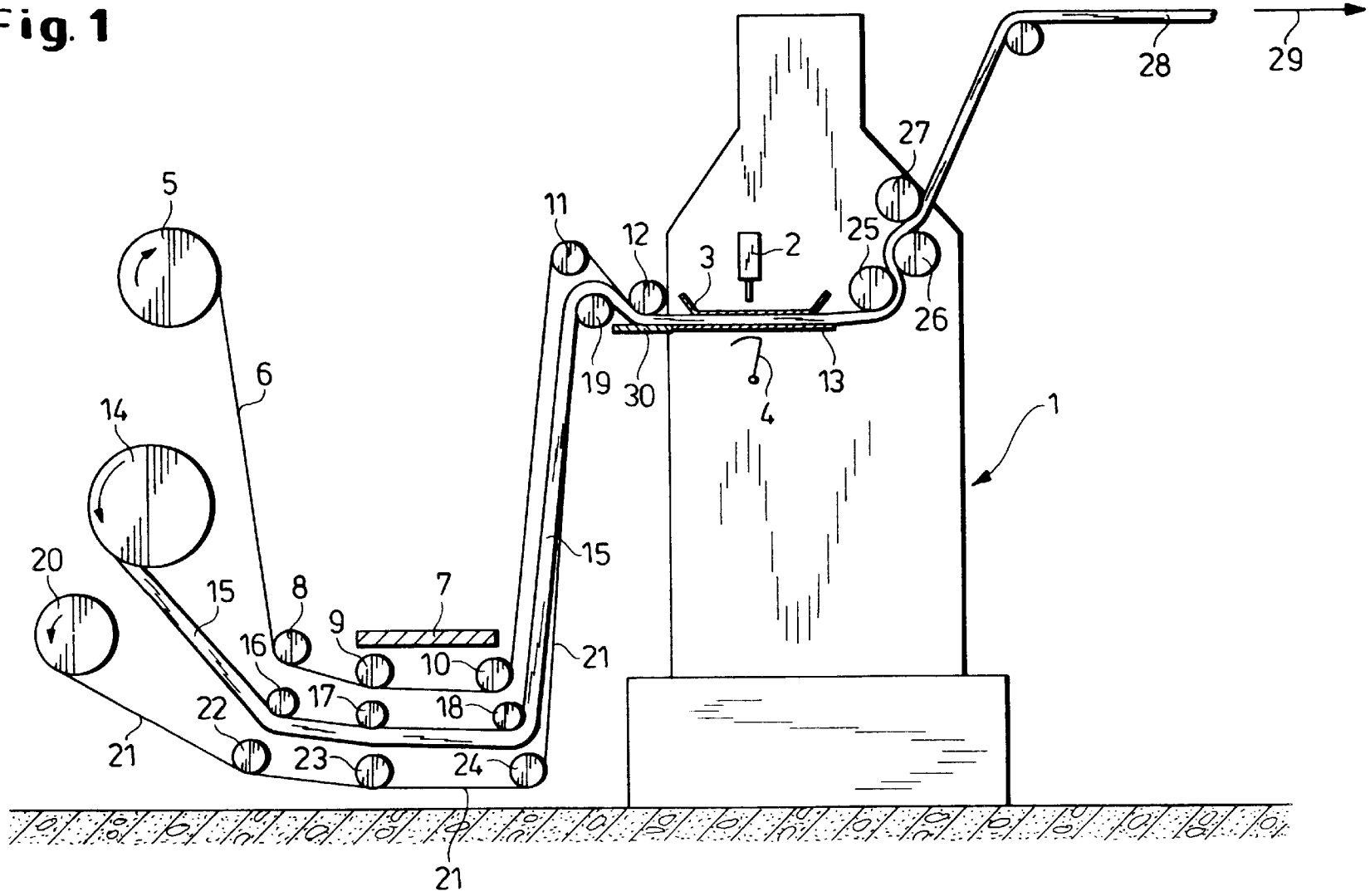
FIG. 1 a schematical side view of a multiple-needle sewing machine.

A multiple-needle sewing machine comprises a machine frame 1 having a needle row 2 in its upper part, wherein the individually driven needles are juxtaposed substantially vertically to the picture plane. Reference number 3 designates a conventional pressure foot and reference number 4 a shuttle row corresponding to the needle row 2. Below the sewing material layers brought together in the sewing area is arranged a needle plate 13 or sewing table.

The sewing material is comprised of a top layer 6, e.g. an upper cloth, mattress drill or the like, and is withdrawn from a supply roller 5 and guided into the sewing area, i.e. into the area between the pressure foot and the supporting plate 13, underneath an operator pedestal 7 via deflection rollers 8, 9, 10, 11 and 12. Said sewing material layer 6 consists of a non-elastical material. In addition, the sewing material comprises a further layer 15 of elastical material, for instance foamed material, which is stored on a supply roller 14. For this elastical layer 15, too guide or deflection rollers 16, 17, 18 and 19 are provided.

Said layer 15 of elastical material is stitched together with said top layer 6 of non-elastical material as well as with another layer 21 in the sewing unit and is withdrawn from the sewing unit as a completely stitched product in the direction of arrow 29, wherein the feeding of the layers 6, 15 and 21 is effected through the force acting on the completely stitched product 28. Past the sewing unit, said completely stitched product 28 passes a distance including deflection or guide rollers 25, 26 and 27, which distance provides for the sewing material 28 to be tightly stretched in the outlet area of the sewing unit.

The bottom layer 21, which is withdrawn from the supply roller 20, is fed to the sewing unit via deflection or guide rollers 22, 23 and 24, wherein the bottom layer 21 corresponding to FIG. 2 may also be fed together with the top layer 6 and the layer 15 of the deflection roller 12 which are described in detail in the following.

Vis à vis said deflection roller 12 a support 30 is provided, wherein the distance between the outer circumference of said deflection roller 12 and said support 30 is adjustable, which means that either the deflection roller 12 is movable relative to the support 30 or that the support 30 is movable relative to the deflection roller 12. Alternatively, it may be provided that both said support 30 and deflection roller 12 are adjustable in the vertical direction. This embodiment serves for adapting said multiple-needle sewing machine to layers 6 and 15 of different thickness, wherein said layer 15 of elastical material is much thicker than said layer 6 of non-elastical material. It is necessary that the deflection roller 12 acts on said material layers 6, 15 at a predetermined pressure in order to provide the required friction forces.

The deflection roller 12 represents a device topping said sewing unit, by means of which device the layer 15 of elastical material is fed to the sewing unit at a speed which is relatively higher than the speed of the layer of non-elastical material, wherein the layer 15 of elastical material is bulged within the area of the deflection roller 12 and is, under maintaining said bulged condition, fed to the sewing unit together with the top layer 6 and the bottom layer 21. To this end, the deflection roller for the top layer 6 is arranged above the deflection roller 19 for the layer 15, so that the top layer 6 ascends the deflection roller 12 under a larger angle relative to the surface of the support 30 or needle plate 13 than the layer 15 of elastical material which is guided over the deflection roller 19. In this respect it is necessary that both the top layer 6 and the layer 15 of elastical material ascend the deflection roller 12 under an angle which is larger than 5 ° relative to the upper surface of the support 30 or needle plate 13. Due to this construction the circumferential distance of the top layer 6 on the deflection roller 12 is smaller than the circumferential distance of the layer 15 of elastical material, since the radius of the deflection roller 12 is smaller than the radius of the deflection roller 12 plus approximately half the material thickness of the layer 15 of elastical material in which the neutral line is arranged, i.e. the line at which the elastical material during its wrapping around said deflection roller 12 is neither stretched nor bulged. By this construction the layer 15 of elastical material is given a slightly higher conveying speed than the layer 6 of non-elastical material, so that bulging of the elastical material is produced in the zone between the deflection roller 12 and the pressure foot 3, which bulged condition is maintained up and into the area of said one needle row 2 or plural needle rows 2 so that the top layer 6 in the stretched condition is stitched together with the bulged layer 15 of the elastical material. Thereby stretching of the elastical material due to the frictional resistance on the upper surface of the support 30 or on the bottom layer 21 is compensated with the consequence that shrinking of the previously stretched elastical material does not take place after the sewing process.

Depending on the configuration of the above-described device, the expansion of the elastical material can be compensated by a corresponding bulging, or bulging of the elastical material may be effected which overcompensates the expansion of the elastical material, so that after the sewing process the elastical material expands and stretches the top layer 6.

Figure 3:
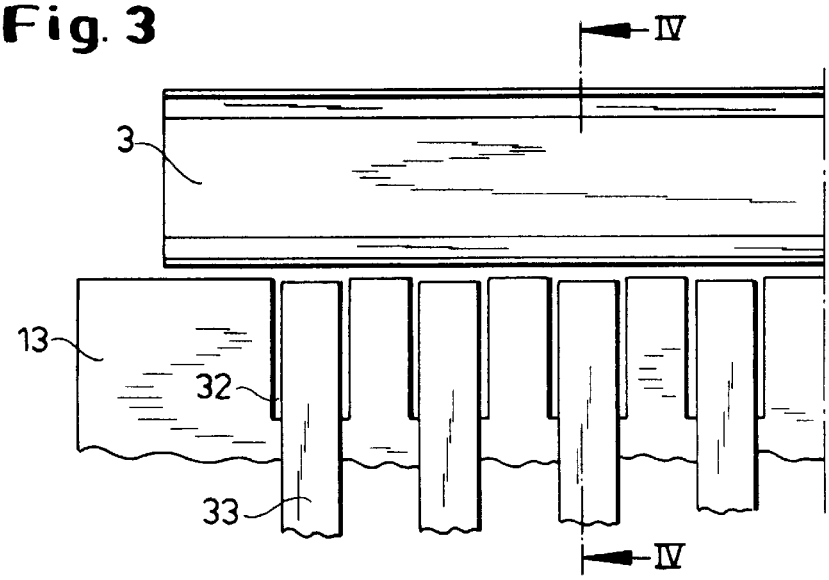
FIG. 3 a second embodiment of a device according to FIG. 2, in a partial lateral representation.
Figure 4:
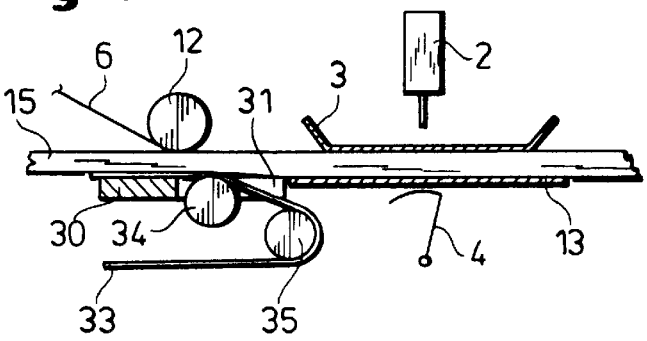
FIG. 4 the device according to FIG. 3 in a partial sectional side view along line IV—IV in FIG. 3, and FIG. 5 the multiple-needle sewing machine according to FIG. 1 in a perspective view.

An alternative embodiment is shown in FIGS. 3 and 4.

In this embodiment the support 30 is formed as a dovetail sheet metal plate comprising a plurality of dovetails 31, wherein between said dovetails 31 a rectangular incision 32 is respectively provided in which a conveyor belt 33 is arranged. The incisions 32 extend to a point directly in front of the pressure foot 3, so that the conveyor belts 33 are also guided up and into this area. Each conveyor belt is arranged so that its upper surface fed to the pressure foot 3 slightly protrudes beyond the upper surface of the support 30 or dovetails 31 in order to ensure safe transfer of the layer 15 of elastical material, which layer is conveyed in the bulged condition between the pressure foot and the needle plate 13. FIG. 4 shows that besides the layer 15 of elastical material also the layer of non-elastical material is conveyed after passing the deflection roller in the area between the pressure foot 3 and the needle plate 13. For guiding the conveyor belts 33 each conveyor belt has one or plural deflection rollers 34 and 35, of which deflection roller 34 is arranged in the area directly in front of the pressure foot in such a fashion that the conveyor belt 33 is, at the end of the incision 32, guided into the portion below the support 30.

With this embodiment, the layer 15 of elastical material is conveyed by means of the conveyor belts 33 in the direction of the pressure foot 3 at a speed which is higher than the speed of the top layer 6, so that the elastical material of the layer 15 is bulged in front of the pressure foot 3 and is fed in this bulged condition to the portion between the pressure foot 3 and the needle plate 13 together with the top layer 6, wherein the two layers 6 and 15 are stitched together. In this way the same successful effect is obtained as in the above-described device according to FIGS. 1 and 2.

Figure 5:
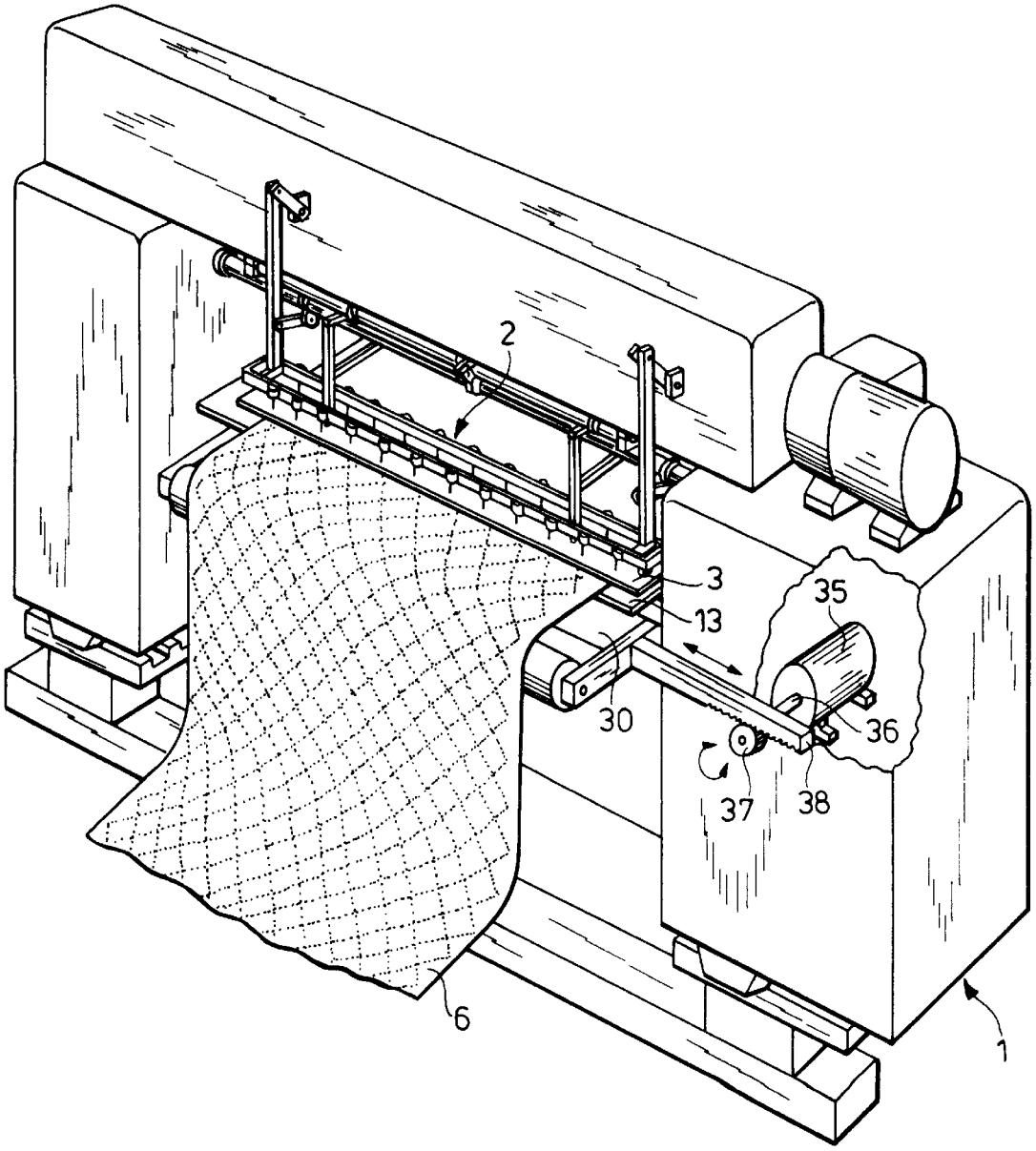

It can be seen in FIG. 5 that the pressure foot 3 and the needle plate 13 are not movable in the direction of the machine frame 1, whereas the support 30 is arranged to be movable relative to the pressure foot 3 and the needle plate 13 in the longitudinal direction of the machine frame 1, so that the sewing material of which only the top layer 6 of non-elastical material is represented in FIG. 5 is movable relative to the needle row 2 in such a way that any sewing patterns can be transmitted to the sewing material. For moving the support 30 an electric motor 35 is provided in the machine frame 1, said motor comprising a pinion 37 on its driving shaft 36 which pinion 37 meshes with the teeth of a toothed rack 38 rigidly connected to said support 30.

Figure 2:
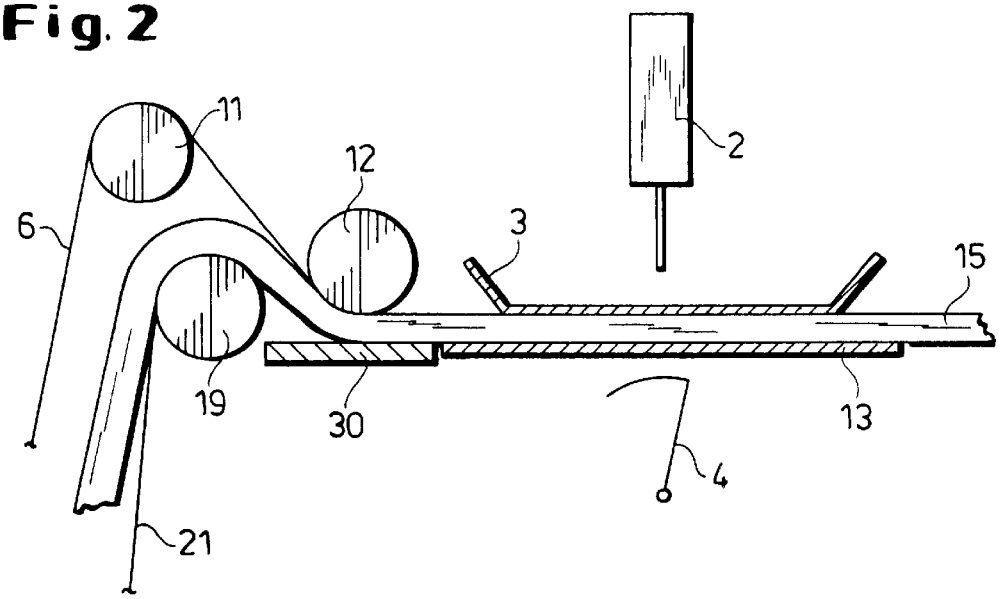
FIG. 2 a first embodiment of a device for increasing the relative speed of a layer, in a schematical lateral representation.

As an alternative to the deflection roller 11 for the layer of elastical material shown in FIGS. 1 and 2 a stationary rod may be provided which offers the advantage that the friction of the non-elastical material drawn over said rod stretches the layer 6 of elastical material between the rod and the roller 12. In this case, the friction in the area of the rod should be as high as possible, while the friction in the area of the deflection roller 19 should be as small as possible so that the layer 15 of elastical material is stretched as little as possible between the deflection roller 19 and the sewing unit.

The invention is not limited to the examples described. In The invention it is essential that during stitching the two layers 6 and 16 together the elastical layer 15, against its property to be expanded due to friction on the support 30, is in place for being stitched at an excessive amount of material so that shrinking of the previously expanded elastical material does not take place after the sewing process.

I claim:

1. A method of sewing large area sewing material in a multiple-needle sewing machine, said sewing material consisting of plural and at least two layers, of which at least one layer is formed of an elastical material, wherein said layers are fed to the sewing unit in a superposed relationship and are conveyed in any direction in the sewing material plane, characterized in that the layer formed of elastical material is fed to the sewing unit in a condition unexpanded in the sewing direction and is stitched together with the layer formed of non-elastical material.

2. The method according to claim 1, characterized in that the layer of elastical material immediately in front of the sewing unit has a higher feeding speed, at least compared to the second layer of non-elastical material.

3. The method according to claim 1, characterized in that the layer of elastical material is fed in a bulged condition.

4. The method according to claim 1, characterized in that the layers are conveyed through the sewing unit by a tractive force applied on the stitched material.

5. The method according to claim 4, characterized in that the tractive force is applied on the layer of non-elastical material.

6. The method according to claim 1, characterized in that the non-stitched layers are guided over a deflection device under different angles before said layers enter the sewing unit between a pressure foot and a needle plate corresponding to a needle row or a shuttle row.

7. The method according to claim 6, characterized in that feeding of the layer formed of non-elastical material takes place under a larger angle relative to a plane of the deflection device than that of the layer formed of non-elastical material.

8. The method according to claim 6, characterized in that the layer formed of elastical material is fed under an angle of at least 5° relative to said plane.

9. The method according to claim 1, characterized in that the layer formed of elastical material is conveyed by means of a driven conveying device over a predetermined distance up to a point immediately in front of the sewing unit area.

10. The method according to one of the claims 1 to 9, characterized in that the layer formed of elastical material is bulged in the area in front of the sewing unit at least in the conveying direction.

11. The method according to claim 10, characterized in that the layer formed of elastical material is bulged corresponding to its possible expansion, so that the layer formed of elastical material expands to its original dimension after the sewing process.

12. The method according to claim 10, characterized in that the layer formed of elastical material is, in front of the sewing unit, bulged to an extent which is greater than the extent of the possible and/or average expansion of said layer of elastical material along the conveying distance.

13. The method according to claim 1, characterized in that another layer, is fed simultaneously with said layer of elastical material, wherein said layer of elastical material is arranged between said two layers.

14. A multiple-needle sewing machine for sewing large area sewing material which consists of plural and at least two layers, wherein at least one layer is formed of an elastical material, said sewing machine comprising a sewing unit, a storage mechanism for the layers to be stitched together, and a storage device for withdrawing and receiving the stitched layers from the sewing unit, characterized by a device topping said sewing unit, by means of which device the layer of elastical material is, in an unexpanded condition in the area of said device, fed to said sewing unit under maintaining said unexpanded condition, together with the other layer or layers.

15. The multiple-needle sewing machine according to claim 14, characterized in that the device is in the form of a deflection member which is arranged substantially immediately in front of a pressure foot of the sewing unit and has a shape of a circular arc segment.

16. The multiple-needle sewing machine according to claim 15, characterized in that the deflection member is formed as a roller having a circular cross-section, onto which roller the layers ascend under different angles relative to a plane particularly defined by the needle plate.

17. The multiple-needle sewing machine according to claim 15, characterized in that the deflection member is arranged vis à vis a support and that a gap is maintained between the deflection member and the support.

18. The multiple-needle sewing machine according to claim 17, characterized in that the gap formed by the distance between the deflection member and the support is adjustable.

19. The multiple-needle sewing machine according to claim 18, characterized in that the deflection member and/or the support are arranged to be movable relative to each other.

20. The multiple-needle sewing machine according to claim 16, characterized in that the deflection member is topped with a roller for guiding said layer of elastical material in such a fashion that this layer ascends the deflection member under an angle of at least 5° and that the layer of non-elastical material ascending between said layer of elastical material and said deflection member ascends the deflection member under an angle which is larger than the angle under which the layer of elastical material ascends.

21. The multiple-needle sewing machine according to claim 14, characterized in that the device is formed as an endless conveyor including at least one conveyor belt onto which said layer of elastical material ascends.

22. The multiple-needle sewing machine according to claim 11, characterized in that plural synchronized conveyor belts are arranged one beside the other.

23. The multiple-needle sewing machine according to claim 21, characterized in that the conveyor belt or the conveyor belts reach up and into a zone immediately in front of the pressure foot.

24. The multiple-needle sewing machine according to claim 21, characterized in that the conveyor belt or the conveyor belts are arranged within incisions in the support.

25. The multiple-needle sewing machine according to claim 24, characterized in that the incisions reach up and into a zone immediately in front of the pressure foot and extend in the conveying direction.

26. The multiple-needle sewing machine according to claim 24, characterized in that the support is formed as a dovetail sheet metal plate of which the dovetails extend in the conveying direction and between which dovetails the conveyor belts are arranged.

* * * * *